US005351183A

United States Patent [19]

Takahashi et al.

[11] Patent Number: 5,351,183

[45] Date of Patent: Sep. 27, 1994

[54] INK DROPLET EJECTION DEVICE FOR A DROP-ON-DEMAND TYPE PRINTER

[75] Inventors: Yoshikazu Takahashi, Kasugai; Masahiko Suzuki, Nagoya; Hiroto Sugahara, Aichi; Takahiro Kanegae, Nagoya, all of Japan

[73] Assignee: Brother Kogyo Kabushiki Kaisha, Aichi, Japan

[21] Appl. No.: 953,534

[22] Filed: Sep. 21, 1992

[30] Foreign Application Priority Data

Sep. 19, 1991 [JP] Japan ..... 3-239183
Sep. 20, 1991 [JP] Japan ..... 3-241500

[51] Int. Cl.[5] ..... B41J 2/045
[52] U.S. Cl. ..... 347/69
[58] Field of Search ..... 346/140 R; B41J 2/045

[56] References Cited

FOREIGN PATENT DOCUMENTS 63-247051 10/1988 Japan ..... B41J 2/045
63-252750 10/1988 Japan ..... B41J 2/045
4-148934 5/1992 Japan ..... B41J 2/045

*Primary Examiner*—Benjamin R. Fuller
*Assistant Examiner*—Alrick Bobb
*Attorney, Agent, or Firm*—Oliff & Berridge

[57] ABSTRACT

An array of ink droplet ejection devices for use in a drop-on-demand type printer includes a piezoelectric transducer and a cover plate. Both the piezoelectric transducer and the cover plate are formed with a plurality of grooves in parallel to one another. The groove-formed surfaces of the piezoelectric transducer and the cover plate are engaged with each other to form a plurality of ink channels. The piezoelectric transducer and the cover plate are in surface contact with each other at the side surfaces of the respective protrusions. The protrusion of the piezoelectric transducer is uni-directionally deformable to be substantially out of surface contact with the protrusion of the cover plate. With such a construction, the individual ink channels can be operated independently of one another and ink droplets can be simultaneously ejected from the adjacent ejection devices.

10 Claims, 4 Drawing Sheets

INK DROPLET EJECTION DEVICE FOR A DROP-ON-DEMAND TYPE PRINTER

BACKGROUND OF THE INVENTION

1. Field of the Invention

The present invention relates to an ink droplet ejection device for a drop-on demand type printer, and more particularly to an ink droplet ejection device operable in accordance with deformation of a piezoelectric transducer.

2. Description of the Prior Art

Recently, there has been proposed a printer using a piezoelectric ink jet head. Such type of printer is specifically called a drop-on demand printer in which an ink droplet is ejected from an orifice when a volume of an ink channel is decreased owing to the inward deformation of a piezoelectric transducer while ink is supplemented into the ink channel through a valve when the volume of the ink channel is increased owing to the outward deformation of the piezoelectric transducer. A plurality of such ejection devices are juxtaposed to provide an ejection unit and ink droplets are ejected from selected ejection devices to print a desired character, graphic or image.

Ink droplet ejection devices of the type described above are disclosed in Japanese Laid-Open Patent Publications Nos. 63-247051 and 63-252750. Such a prior art device will be described with reference to FIGS. 1, 2 and 3.

Referring first to FIG. 1, an ejection device array includes a piezoelectric ceramic plate 1 and a cover plate 2. The piezoelectric ceramic plate 1 is formed with a plurality of protrusions 13*a* through 13*d* on one surface thereof and is polarized in a direction of its thickness indicated by an arrow d. The cover plate 2 is made of such a material as metal, glass, ceramics or resin. The piezoelectric plate 1 and the cover plate 2 are bonded together with an adhesive material 5 to form horizontally spacedly arranged ink channels 31*a*, 31*b* and 31*c*. The ink channels 31*a*, 31*b* and 31*c* are defined by the cover plate 2 and the protrusions 13*a* through 13*d* serving as side walls of the ink channels. Each ink channel is rectangular in cross-section and extends in a direction perpendicular to the sheet of drawing. Each of the side walls 13*a* through 13*d* is deformable in a direction perpendicular to both the polarization direction and the longitudinal direction of the ink channel, thereby changing an ink pressure in the ink channel. Metal electrodes, such as 11*a* through 11*d*, are formed on the surface of the side walls 13*a* through 13*d*, respectively. Driving electric field is selectively applied to the metal electrode to actuate the corresponding ejection device. The metal electrodes 11*a* through 11*d* are subjected to surface treatment to inhibit corrosion by the ink.

The ejection device array thus constructed will operate in such a manner that when the ejection device 31*b* is selected by print data, a driving electric field is applied between the metal electrodes 11*a* and 11*b* and between 11*c* and 11*d*. Since the electric field direction and the polarization direction are orthogonal to each other, both the side walls 13*b* and 13*c* are inwardly deformed with respect to the ink channel 31*b* as shown in FIG. 2 according to a piezoelectric thickness shearing effect. This inward deformations of the side walls 13*b* and 13*c* reduces the inner volume of the ink channel 31*b* and thus increases an ink pressure, resulting in an ejection of an ink droplet from an orifice (not shown).

When the application of the electric field is stopped, restoration of the side walls occurs, so that the ink pressure in the ink channel is decreased and ink is supplemented into the ink channel from an ink supplier (not shown).

Manufacturing process of the ejection array will next be described with reference to FIG. 3. By way of grinding machining with a rotating diamond cutter disk, a plurality of grooves of rectangular cross-section are formed in parallel in the surface of the piezoelectric ceramic plate 1 which has been polarized in the direction of d. Next, the metal electrodes are formed on the surface of the grooves 3 by way of sputtering and then the cover plate 2 is bonded to the upper surfaces of the groove-formed ceramic plate 1. An orifice plate 4 formed with orifices 41 in positions corresponding to the ink channels is bonded to the side surface of the ceramic plate 1 at the ink ejection side.

In the conventional ejection device array as described above, there is a problem in that the neighboring ejection devices cannot be actuated simultaneously thus ink ejections from the neighboring ejection devices do not occur simultaneously. Because the side wall common to two neighboring ejection devices deforms in a push-pull fashion. Specifically, when the common side wall is inwardly deformed with respect to one of the two neighboring ink channel, the deformation direction of the same side wall is outward with respect to the other ink channel. Consequently, printing of characters or graphic images with such ejection device requires complicated control and the printing speed is slowed down.

Another problem with the conventional ink ejection device is that the device cannot be operated with a low driving voltage. This is because the piezoelectric ceramic plate forms the side wall and the bottom wall of the ink channel while serving as a piezoelectric actuator. More specifically, the efficiency of the piezoelectric thickness shearing effect is enhanced as a ratio of the side wall width of the ink channel to the height of the side wall, i.e., (width)/(height), becomes smaller. Further, the driving voltage can be lowered if the side wall width becomes thinner, because the electrode-to-electrode distance becomes smaller as the side wall width of the ink channel is thinner. As a matter of fact, however, it is extremely difficult to reduce the width of the side wall and to increase the height thereof. Weakness inheres in the material of the piezoelectric ceramic plate. Thus, the yieldability in the manufacture of the ejection devices is degraded and the strength of the manufactured product is lowered resulting in loss of reliability if the piezoelectric plate is manufactured so that the interval of the grooves is too small and/or the groove is too deep.

SUMMARY OF THE INVENTION

The present invention has been made to solve the aforesaid problems and accordingly it is an object of the invention to provide an ink droplet ejection device which is effectively operable in printing characters or graphic images.

Another object of the invention is to provide a reliable and a low-voltage operable ink ejection device.

Still another object of the invention is to enable manufacturing of the ink ejection devices with excellent yieldability.

To achieve the above and other objects, there is provided, according to one aspect of the invention, an array of ink droplet ejection devices which includes a piezoelectric transducer having first and second ends and being formed with a plurality of grooves on one surface thereof. The grooves extend from the first end to the second end in parallel to one another at equally-spaced intervals. Each groove is defined by two side walls and a bottom surface, each side wall having side surfaces and a top surface. First and second electrodes are separately provided on the side surfaces of each side wall, and a driving unit is provided for applying an electric field between the first and second electrodes. The array further includes a cover plate having first and second ends and is formed with a plurality of grooves on one surface thereof. The grooves of the cover plate extends from the first end to the second end in parallel to one another at equally-spaced intervals and having a pitch such that the sum of the width of a side wall and a groove of the cover plate is equal to the sum of the width of a side wall and a groove of the piezoelectric transducer. Each groove of the cover plate is defined by two side walls and a bottom surface, each side wall of the cover plate having side surfaces and a top surface. An orifice plate is attached to the first ends of both the piezoelectric transducer and the cover plate. The orifice plate is formed with a plurality of orifices. An ink tank is connected to the second ends of both the piezoelectric transducer and the cover plate.

The groove-formed surfaces of the piezoelectric transducer and the cover plate are engaged with each other so that the side walls of the piezoelectric transducer and the cover plate are alternately arranged to form a plurality of ink channels. The piezoelectric transducer and the cover plate are in surface contact with each other at the side surfaces of the respective side walls. The contacting side wall of the piezoelectric transducer is uni-directionally deformable to be substantially out of surface contact with the side wall of the cover plate when the electric field is applied between the first and second electrodes of the side wall of the piezoelectric transducer. Each ink channel is defined by the side surface of the side wall of the piezoelectric transducer, the side surface of the side wall of said cover plate, and the bottom surfaces of both the piezoelectric transducer and the cover plate.

In accordance with another aspect of the invention, there is provided an array of ink droplet ejection devices wherein each side wall of the piezoelectric transducer is of a first height and each side wall of the cover plate is of a second height higher than the first height.

The piezoelectric transducer and the cover plate are in surface contact with each other at the side surfaces of the respective side walls. The contacting side wall of the piezoelectric transducer is deformable to a first extent when the electric field is applied between the first and second electrodes of the side wall of the piezoelectric transducer. The contacting side wall of the cover plate is deformed to a second extent greater than the first extent. An inner volume of each of the plurality of ink channels is reduced by the deformation of the side wall of the cover plate to thus eject an ink droplet from the associated orifice.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

While the ink droplet ejection device of the present invention is susceptable of numerous physical embodiments depending upon the environment and requirements of use, substantial numbers of the herein shown and described embodiments have been made, tested and used, and all have performed in an eminently satisfactory manner.

Figure 6:
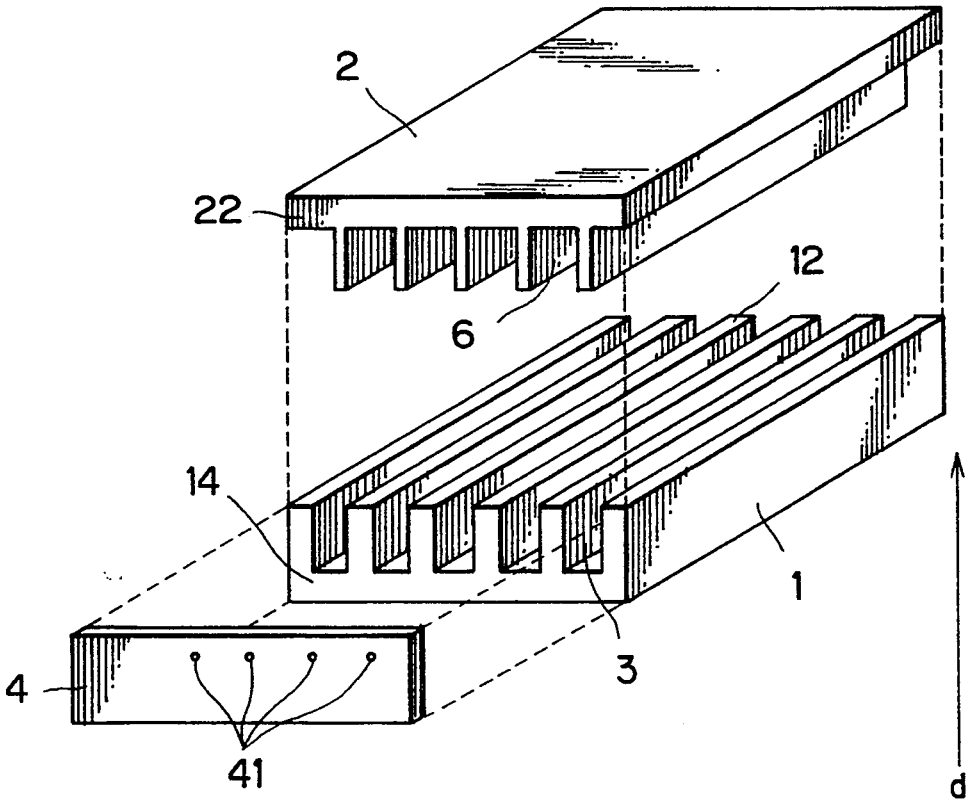
FIG. 6 is a perspective view showing a manufacturing process of the ejection device according to the first embodiment of the present invention.

Referring now to the drawings wherein like reference numerals refer to like parts throughout, reference will first be made to FIG. 4 wherein there is shown an array of ejection devices which includes a piezoelectric ceramic plate 1 serving as a piezoelectric transducer and a cover plate 2. The piezoelectric ceramic plate 1 is made of a ceramic material containing lead zirconate titanate (PZT) as a primary component. As best shown in FIG. 6, the piezoelectric ceramic plate 1 has a front end 14 and a rear end 12 and is formed with a plurality of grooves 3 extending in parallel to one another in a first direction from the front end 14 to the rear end 12 at equally-spaced intervals. Referring back to FIG. 4, each groove 3 is defined by two side walls and a bottom surface. The ceramic plate 1 is polarized in a direction of its thickness indicated by an arrow d (hereinafter referred to as "second direction") perpendicular to the first direction. The ceramic plate 1 may be polarized in the opposite direction. The cover plate 2 is made of such a material as metal, glass, ceramics or resin and is of the same size as the ceramic plate 1 in both the length in the first direction and the width in a third direction perpendicular to both the first and second directions.

First and second metal electrodes are separately provided on the side surfaces of each of the side walls 13*a*, 13*b* and 13*c*. In the drawing, denoted by reference numerals 11*a*, 11*c* and 11*e* are the first electrodes of the side walls 13*a*, 13*b* and 13*c* and denoted by reference numerals 11*b*, 11*d* and 11*f* are the second electrodes of the side walls 13*a*, 13*b* and 13*c*, respectively. The electrodes are surface treated to avoid ink corrosion.

Figure 1:
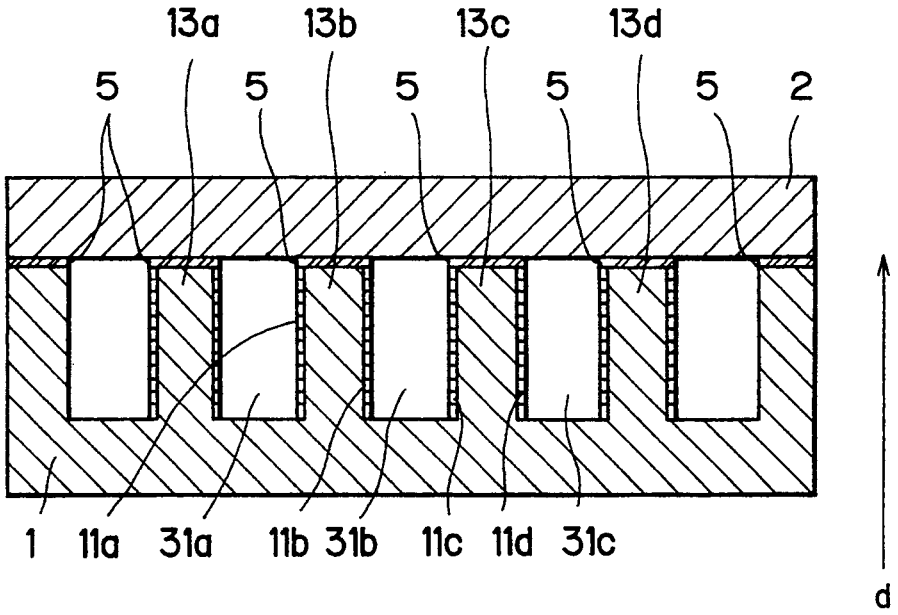
FIG. 1 PRIOR ART
FIG. 1 is a cross-sectional view showing a part of a conventional ink droplet ejection device array.
Figure 2:
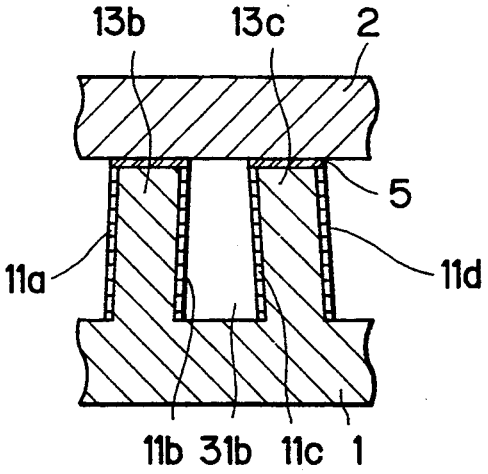
FIG. 2 PRIOR ART
FIG. 2 is a cross-sectional view showing an ink channel of the conventional ejection device deformed by the application of a driving electric field.
Figure 3:
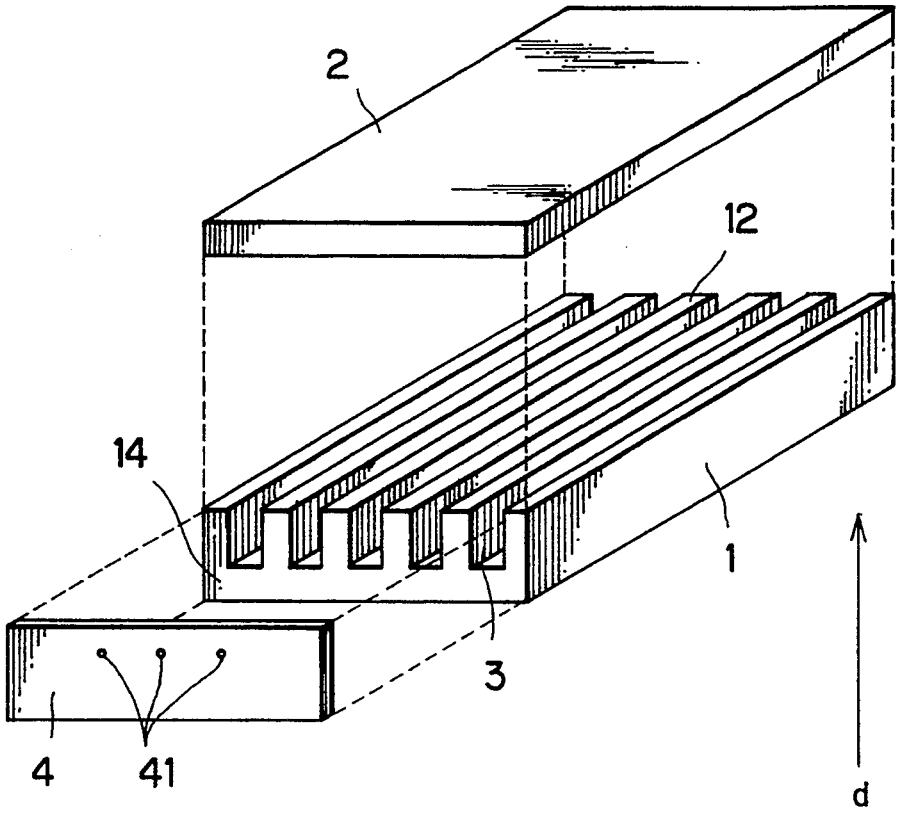
FIG. 3 PRIOR ART
FIG. 3 is a perspective view showing a manufacturing process of a conventional ejection device.
Figure 4:
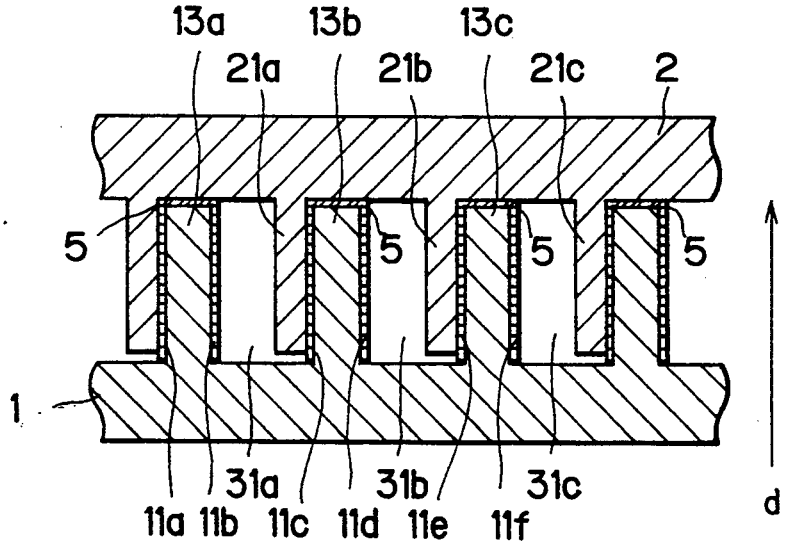
FIG. 4 is a cross-sectional view showing a part of an ink droplet ejection device array according to a first embodiment of the present invention.
Figure 5:
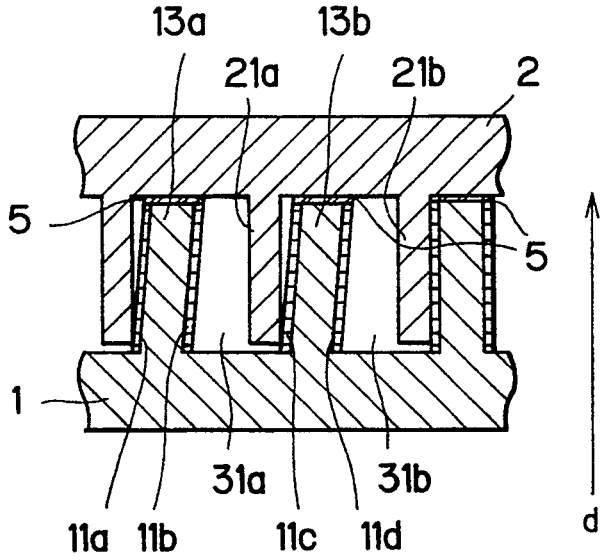
FIG. 5 is a cross-sectional view showing an ink channel of the ejection device deformed by the application of a driving electric field according to the first embodiment of the present invention.

Although not illustrated in FIGS. 4 through 6, a driving unit is provided for applying an electric field between the first and second electrodes of each side wall. The driving unit will be described in detail with reference to a second embodiment. As can be best shown in FIG. 6, an orifice plate 4 is attached to the front ends 14 and 22 of the ceramic plate 1 and the cover plate 2. The orifice plate 4 is formed with a plurality of orifices 41 from which ink droplets are ejected. To the rear ends of the ceramic plate 1 and the cover plate 2, an ink tank 7 is connected for supplementing an ink to the ink channels 31*a*, 31*b*, 31*c*.

The cover plate 2 is formed with a plurality of grooves 6 on one surface thereof. The grooves 6 of the cover plate 2 extend in the first direction in parallel to one another at equally-spaced intervals that are off-set from the grooves of the ceramic plate 1 such that the walls of the cover plate 2 and the ceramic plate 1 are side by side in a paired relationship when the cover plate 2 and the ceramic plate 1 are joined. Each groove 6 of the cover plate 2 is defined by two side walls and a bottom surface. Each side wall of the cover plate 2 has side surfaces and a top surface.

To assemble the piezoelectric ceramic plate 1 and the cover plate 2, the groove-formed surfaces of the plates 1 and 2 are engaged with each other so that the side walls of the plates 1 and 2 are alternately arranged to form a plurality of ink channels 31*a*, 31*b*, 31*c* having a rectangular cross-section. The ceramic plate 1 and the cover plate 2 are in surface contact with each other at the side surfaces of the respective side walls 13*a* through 13*b* and 21*a* through 21*c*. The side walls 13*a*, 13*b*, 13*c* of the ceramic plate 1 are unidirectionally deformable in the third direction to be substantially out of surface contact with the side walls of the cover plate 2 when the electric field is applied between the first and second electrodes. Each of the ink channels 31*a*, 31*b* and 31*c* is defined by the side surface of a side wall of a ceramic plate 1, a side surface of the side wall of the cover plate 2, and the bottom surfaces of both the ceramic plate 1 and the cover plate 2.

The heights of the side walls 13*a*, 13*b*, 13*c* of the ceramic plate 1 are substantially equal to or otherwise a little higher than the heights of the side walls 21*a*, 21*b*, 21*c* of the cover plate 2. The top surfaces of the side walls 13*a*, 13*b*, 13*c* and the bottom surfaces of the grooves adjacent side walls 21*a*, 21*b*, 21*c* are bonded together by an adhesive material 5 such as epoxy resin, or the top surfaces of the side walls 21*a*, 21*b*, 21*c* and the bottom surfaces of the grooves adjacent side walls 13*a*, 13*b*, 13*c* may be bonded together, or both. In lieu of bonding the ceramic plate 1 and the cover plate 2, may be combined using tightening members such as bolts.

The array of ejection devices thus constructed will operate in such a manner that when the ink channels 31*a* and 31*b* are selected by print data, a driving electric field is applied between the metal electrodes 11*a* and 11*b* and between the metal electrodes 11*c* and 11*d*. Since the electric field direction and the polarization direction are orthogonal to each other, the side walls 13*a* and 13*b* are deformed inwardly of the respective ink channels 31*a* and 31*b*, respectively, as shown in FIG. 5. The ink channel 31*a* is defined by the bottom surface of the piezoelectric ceramic plate 1, the side wall 13*a* of the plate 1, the bottom surface of the cover plate 2, and the side wall 21*a* of the plate 2. On the other hand, the ink channel 31*b* is defined by the bottom surface of the plate 1, the side wall 13*b* of the plate 1, the bottom surface of the cover plate 2, and the side wall 21*b* of the plate 2. By the inward deformations of the side walls 13*a* and 13*b*, the inner volumes of both the ink channels 31*a* and 31*b* are reduced and thus the ink pressures in these ink channels are increased, resulting in ejections of ink droplets from the corresponding orifices 41. When the application of the electric fields are stopped, restorations of the side walls 13*a* and 13*b* occur. Then, the ink pressures in the ink channels 31*a* and 31*b* are decreased and ink is supplemented into the ink channels from the ink tank (not shown).

The manufacturing process of the array will next be described with reference to FIG. 6. By way of grind machining using a rotating diamond cutting disk or machining with a laser beam, a plurality of grooves 3 of rectangular cross-section are formed in parallel in one surface of the piezoelectric ceramic plate 1 which has been polarized in advance in the direction of d. A pair of metal electrodes are then formed on the surface of each side wall of the plate 1 by way of sputtering or plating. The cover plate 2 is made of such a material as metal, glass, ceramics or resin. The manufacturing process of the cover plate 2 differs depending on the material of the cover plate 2 used. Basically, one surface of the cover plate 2 is formed with a plurality of grooves 6 of rectangular cross-section through grinding and shaping with the use of grindstones.

The groove-formed surfaces of the ceramic plate 1 and the cover plate 2 are brought into engagement with each other and are bonded together to form the ink channels. Finally, the orifice plate 4 is secured to the front ends 14 and 22 of the assembled ceramic plate 1 and the cover plate 2 so that the orifices 41 formed in the orifice plate 4 are in alignment with the ink channels.

According to the first embodiment of the invention, the piezoelectric ceramic plate 1 and the cover plate 2 are engaged with each other and bonded together so that each ink channel is defined by the inwardly deformable wall of the ceramic plate 1, the wall of the cover plate 2 which is in surface contact with the adjacent deformable wall of the ceramic plate 1, and the bottom surfaces of the ceramic plate 1 and the cover plate 2. The wall of the cover plate 2 remains stationary when the contacting wall of the ceramic plate 1 is deformed to be out of surface contact therewith. As such, two adjacent ejection devices can be simultaneously actuated without causing an interference to eject ink droplets simultaneously. Therefore, printing of characters or graphic images can be accomplished at a higher speed with a simplified control.

Figure 7:
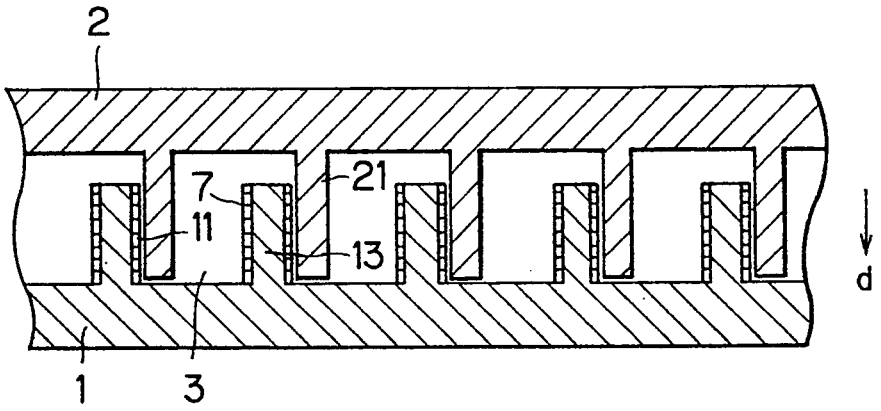
FIG. 7 is a cross-sectional view showing a part of an ink droplet ejection device array according to a second embodiment of the present invention.

Next, a second embodiment of the present invention will be described with reference to FIGS. 7 and 8.

The array of ink droplet ejection devices in accordance with the second embodiment also includes a piezoelectric ceramic plate 1 and a cover plate 2. The cover plate 2 is made of elastic material such as resin, a metal whose surface is subjected to insulation treatment. The ceramic plate 1 is polarized in the direction indicated by an arrow d. The groove-formed configurations of both the piezoelectric ceramic plate 1 and the cover plate 2 are substantially the same as those described in conjunction with the first embodiment. However, the height of the side walls 21 of the plate 2 is higher than the height of the side walls 13 of the plate 1. It is preferred that the former height is 1.3 times as high as the latter height. Therefore, the top surfaces of the side walls 13 of the plate 1 are not in surface contact with the bottom surface of the plate 2 but the top surfaces of the downwardly oriented side walls 21 are in surface contact with the bottom surfaces of the ceramic plate 1. The spacing and positioning of the grooves and the side walls of cover plate 2 and ceramic plate 1 with respect to one another are as in the first embodiment.

At the rear portion of the ceramic plate 1, there is disposed a driving unit which is in the form of an LSI chip 16. The LSI chip 16 is electrically connected to the electrodes 11 of the respective side walls 13. More specifically, as shown in FIG. 8, the electrodes 11*a* through 11*j* are individually connected to the LSI chip 16. Clock line 16A, data line 16B, voltage line 16C and ground line 16D are also connected to the LSI chip 16. The ink ejection devices 34*a* through 34*e* are separated into first and second groups. The ejection devices of the same group are not located adjacent to one another. Clock pulses supplied from the clock line 16A are sequentially applied to the first and second group ejection devices. Multi-bit word format data appearing on the data line 16B are determinative of which ejection devices in the same group are to be actuated and the selected electrodes are applied with a voltage through the voltage line 16C. Then, the corresponding side walls of the ceramic plate 1 are deformed in a manner as illustrated in FIG. 8. The non-selected electrodes belonging to the same group and all the electrodes in another group are grounded through the ground line 16D.

Figure 8:
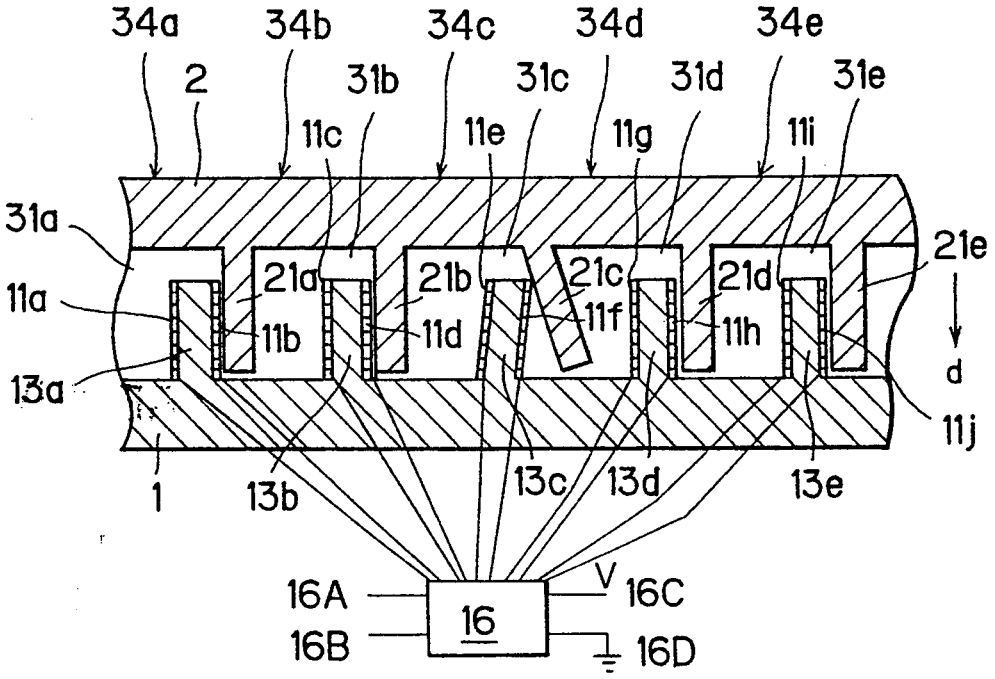
FIG. 8 is a cross-sectional view showing an ink channel of the ejection device deformed by the application of a driving electric field according to the second embodiment of the present invention.

FIG. 8 shows the case where the ejection device 34*d* is selected. A voltage V on the voltage line 16C is applied to the electrode 11*f* while the other electrodes 11*a* through 11*e* and 11*g* through 11*j* are grounded. Since an electric field orthogonal to the polarization direction is applied to the side wall 13*c*, the side wall 13*c* is deformed inwardly of the ink channel 31*d* due to piezoelectric thickness shear effect. At this time, the side wall 21*c* of the cover plate 2 which has been in surface contact with the side wall 13*c* is urged by the side wall 13*c* and deformed inwardly of the ink channel 31*d* to an extent greater than the deformation extent of the side wall 13*c*. As a result, the inner volume of the ink channel 31*d* is decreased and an ink droplet is ejected from the corresponding orifice. If the ejection device 34*c* is selected to actuate, the side wall 13*b* of the ceramic plate 1 is deformed and thus the side wall 21*b* of the cover plate 2 is also deformed, resulting in an ink ejection from the orifice corresponding to the ink channel 31*c*.

When any of the side walls 13*a* through 13*e* are deformed, the corresponding side walls 21*a* through 21*e* are deformed 1.3 times as much as the deformations of the corresponding side walls 13*a* through 13*e*. Therefore, according to a principle of levers which relates generally to the effort and load and states that the effort times its distance from the fulcrum equals the load times its distance from the fulcrum, the deformation of the side walls 21*a* through 21*d* is about 4.3 times (1.3 divided by 0.3) as much as the deformation of the side walls 13*a* through 13*e*. Therefore, assuming that the same volume change in the ink channel is attainable in both the conventional ejection device and the device of this embodiment, the driving voltage to be applied to the side walls 13*a* through 13*e* can be lowered to about 1/2.15. Meanwhile, while in the conventional ejection device two side walls of the piezoelectric ceramic plate are simultaneously deformed to change the inner volume of one ink channel, only one side wall of the piezoelectric ceramic plate is deformed in the device of the invention. Therefore, the lowering rate of the driving voltage applied to the side walls 13*a* through 13*e* becomes 1/(4.3/2).

In this manner, as the lower driving voltage suffices to drive the ejection device and thus it is not necessary to increase the ratio of the width to the height, i.e., (width)/(height), of the side walls of the ceramic plate. Consequently, excellent yieldability at the time of manufacture of the array can be accomplished and the reliability on the strength of the manufactured products are not lowered.

What is claimed is:

1. An array of ink droplet ejection devices, comprising:

a piezoelectric transducer having a first end and a second end and being formed with a plurality of grooves on one surface thereof, the grooves extending from the first end to the second end in parallel to one another at equally spaced intervals, each of said grooves being defined by two side walls and a bottom surface, each of said side walls having side surfaces and a top surface;

first and second electrodes separately provided on the side surfaces of each of said side walls;

a driving unit for applying an electric field between said first and second electrodes;

a cover plate having a first end and a second end and being formed with a plurality of grooves on one surface thereof, the grooves of said cover plate extending from the first end to the second end in parallel to one another at equally spaced intervals that are off set from those of said piezoelectric transducer to permit mating with said piezoelectric transducer, each of said grooves of said cover plate being defined by two side walls and a bottom surface, each of said side walls of said cover plate having side surfaces and a top surface;

an orifice plate attached to the first end of both said piezoelectric transducer and said cover plate, said orifice plate being formed with a plurality of orifices; and an ink tank connected to the second end of both said piezoelectric transducer and said cover plate, wherein the groove-formed surfaces of said piezoelectric transducer and said cover plate are engaged with each other so that the side walls of said piezoelectric transducer and said cover plate are alternately arranged to form a plurality of ink channels, wherein said piezoelectric transducer and said cover plate are in surface contact with each other at the side surfaces of the respective side walls, a contacting side wall of said piezoelectric transducer being uni-directionally deformable to be substantially out of surface contact with a side wall of said cover plate when the electric field is applied between the first and second electrodes of the side wall of said piezoelectric transducer, and wherein each of said ink channels is defined by a side surface of the side wall of said piezoelectric transducer, a side surface of the side wall of said cover plate, and the bottom surfaces of both said piezoelectric transducer and said cover plate.

2. The array according to claim 1, wherein an inner volume of each of the plurality of ink channels is changed by a deformation of an associated side wall of said piezoelectric transducer.

3. The array according to claim 2, wherein the inner volume of each of the plurality of ink channels is reduced by the deformation of the associated side wall of said piezoelectric transducer to thus eject an ink droplet from the associated orifice.

4. The array according to claim 1, wherein each of the plurality of ink channels is of a rectangular shape in cross-section.

5. An array of ink droplet ejection devices, comprising:

a piezoelectric transducer having a first end and a second end and being formed with a plurality of grooves on one surface thereof, the grooves extending from the first end to the second end in parallel to one another at equally spaced intervals, each of said grooves being defined by two side walls and a bottom surface, each of said side walls having a first height and defined by side surfaces and a top surface;

first and second electrodes separately provided on the side surfaces of each of said side walls;

a driving unit for applying an electric field between said first and second electrodes;

a cover plate having a first end and a second end and being formed with a plurality of grooves on one surface thereof, the grooves of said cover plate extending from the first end to the second end in parallel to one another at equally spaced intervals that are off set from those of said piezoelectric transducer to permit mating with said piezoelectric transducer, each of said grooves of said cover plate being defined by two side walls and a bottom surface, each of said side walls of said cover plate having a second height higher than the first height and being defined by side surfaces and a top surface;

an orifice plate attached to the first end of both said piezoelectric transducer and said cover plate, said orifice plate being formed with a plurality of orifices; and an ink tank connected to the second end of both said piezoelectric transducer and said cover plate, wherein the groove-formed surfaces of said piezoelectric transducer and said cover plate are engaged with each other so that the side walls of said piezoelectric transducer and said cover plate are alternately arranged to form a plurality of ink channels, wherein said piezoelectric transducer and said cover plate are in surface contact with each other at the side surfaces of the respective side walls, a contacting side wall of said piezoelectric transducer being deformable to a first extent when the electric field is applied between the first and second electrodes of the contacting side wall of said piezoelectric transducer, a contacting side wall of said cover plate being deformed to a second extent greater than the first extent, and wherein each of said ink channels is defined by a side surface of the side wall of said piezoelectric transducer, a side surface of a side wall of said cover plate, and the bottom surfaces of both said piezoelectric transducer and said cover plate.

6. The array according to claim 5, wherein an inner volume of each of the plurality of ink channels is changed by a deformation of the contacting side wall of said cover plate.

7. The array according to claim 6, wherein the inner volume of each of the plurality of ink channels is reduced by the deformation of the contacting side wall of said cover plate to thus eject an ink droplet from an associated orifice.

8. The array according to claim 5, wherein each of the plurality of ink channels is of a rectangular shape in cross-section.

9. The array according to claim 5, wherein the second height is 1.3 times as high as the first height.

10. The array according to claim 5, wherein said cover plate is made of an elastic material.

* * * * *